United States Patent [19]

Annovi

[11] Patent Number: 4,470,206

[45] Date of Patent: Sep. 11, 1984

[54] SKI BOOT WITH AN ELASTICALLY INCLINABLE FORWARD LEG PORTION

[75] Inventor: Giuseppe Annovi, Treviso, Italy

[73] Assignee: Dolomite S.p.A., Montebelluna, Italy

[21] Appl. No.: 449,683

[22] Filed: Dec. 14, 1982

[30] Foreign Application Priority Data

Dec. 24, 1981 [IT] Italy ..... 62016/81[U]

[51] Int. Cl.[3] ..... A43B 5/04

[52] U.S. Cl. ..... 36/121; 36/54; 36/72 R; 36/117; 36/119; 36/120; 24/68 SK; 24/69 SK; 24/70 SK; 24/71 SK

[58] Field of Search ..... 36/121, 119, 117, 120, 36/54, 72 R; 24/68 SK, 69 SK, 70 SK, 71 SK

[56] References Cited

U.S. PATENT DOCUMENTS

| | | | |
|---|---|---|---|
| 3,178,836 | 3/1965 | Turner | 36/72 R |
| 3,561,139 | 2/1971 | Stillman | 36/119 |
| 4,391,049 | 7/1983 | Parisotto | 36/120 |
| 4,406,073 | 9/1983 | Spademan | 36/119 |

FOREIGN PATENT DOCUMENTS

| | | | |
|---|---|---|---|
| 3115529 | 1/1982 | Fed. Rep. of Germany | 36/117 |
| 2498431 | 7/1982 | France | 36/120 |

*Primary Examiner*—Werner H. Schroeder
*Assistant Examiner*—Mary A. Ellis
*Attorney, Agent, or Firm*—D. Paul Weaver

[57] ABSTRACT

A ski boot consists of a foot portion and a leg portion connected in articulated relationship. A stiffening element at the front of the boot formed of resilient material has substantially the profile of the boot and is attached at least partially to the foot portion and/or the leg portion thereof.

6 Claims, 3 Drawing Figures

SKI BOOT WITH AN ELASTICALLY INCLINABLE FORWARD LEG PORTION

BACKGROUND OF THE INVENTION

This invention relates to a ski boot having an elastically inclinable forward leg portion.

Ski boots are well known which have joined leg and foot portions. A drawback of such boots is that the leg portion affords only a limited range of flexure of the skier's leg, and a slow elastic return to the natural position in the following stage of extension.

In order to eliminate this difficulty, it has been proposed in the prior art that the foot portion near its back be connected to the leg portion through variable strength spring devices or absorbers with rubber caps.

However, this solution presents other difficulties, in particular:

- lack of reliability in both stages of flexure and extension;
- high cost, not only due to the presence of these additional devices, but also to the difficulty in mounting them; and
- difficult replacement in case of breakage.

All of these drawbacks are eliminated in the present invention for a ski boot having an elastically inclinable forward leg portion characterized in that it comprises at the front a stiffening element shaped according to the vertical profile of the ski boot, and joined to this in correspondence of a least one strip, said element being formed by an elasitically pliable elongated member, joined to the boot, and by an elongated interchangeable insert for the stiffening element having greater stiffness.

Advantageously, the stiffening element can be joined near its lower end to the boot by a fixed connector and can be provided at its upper end with a hook or clip engaging in a cooperating slit in the upper edge of the boot or in its tongue.

The elastically pliable portion of the stiffening element can have a longitudinal groove for housing the interchangeable insert element, and the insert element and groove have a complementary cross sectional shape to promote snapping engagement.

The present invention can be further understood with reference to the accompanying drawings forming a part of the application.

DETAILED DESCRIPTION

Figure 1:
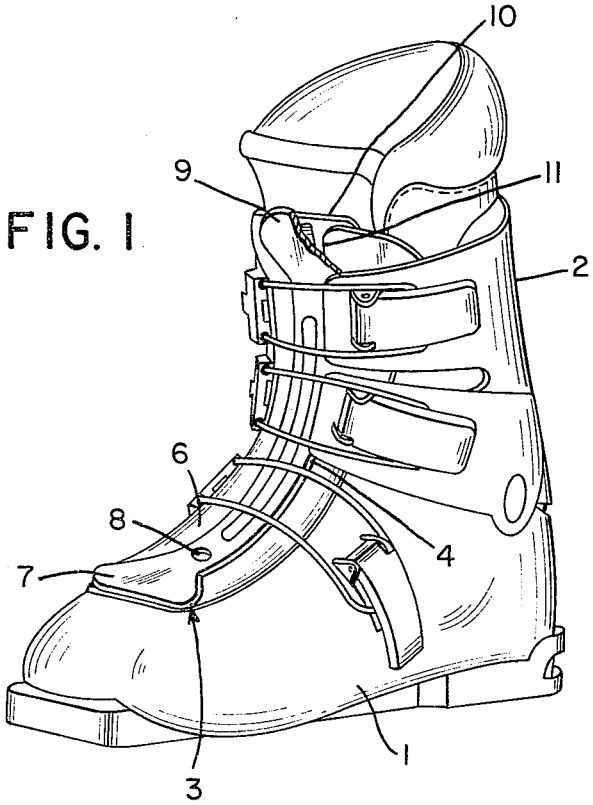
FIG. 1 is a perspective view of a ski boot according to the invention provided with a stiffening element.

As shown in the drawings, a ski boot according to the invention is formed of injected molded plastics material, and comprises a foot portion 1 and a leg portion 2 having the usual lever locking devices.

At the front of the boot, a stiffening element 3 is provided having the profile of the boot tongue and preferably formed of plastics material. This stiffening element comprises an elastically pliable body portion 4 and an interchangeable insert element 5 for the body portion, which can be applied to it and having a greater stiffness than the body portion 4. The bending radius of the stiffening element 3 is slightly greater than the bending radius of the boot tongue 6.

The lower end 7 of stiffening element 3 has a widened triangular shape for more stable support on the tongue 6, and is connected to the boot foot portion 1 by a screw 8. The upper end 9 of the stiffening element also has a widened triangular shape and carries a hooking element 10 or clip engageable in a slit 11 in the upper edge of the tongue 6.

Figure 3:
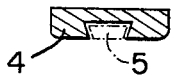
FIG. 3 is an enlarged transverse section taken on line III—III of FIG. 2.
Figure 2:
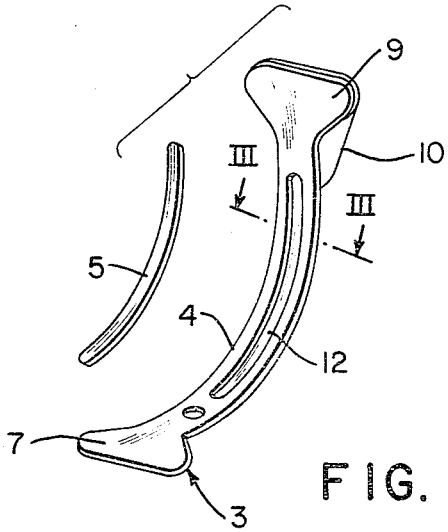
FIG. 2 is an exploded perspective view of the stiffening element.

Furthermore, the elastically pliable body portion 4 of stiffening element 3 contains a longitudinal groove 12 having a dovetailed cross section, FIG. 3. This groove receives the interchangeable insert element 5 formed of metal, plastics or the like and having a complementary cross sectional shape promoting snapped engagement of the insert 5 into the groove 12. The insert element 5, as stated, is of greater stiffness than the body portion 4 of element 3.

Practically, the ski boot may be sold with a series of elements 5, identically shaped, but possessing different degrees of stiffness. A user can choose and snap into the groove 12 the element 5 which provides the best results for skiing requirements.

From the above it clearly results that the ski boot according to the invention offers numerous advantages, in particular:

- an elastic return of the leg portion to the rest position without the use of rear encumberances;
- an efficient contrast action and range during forward flexure of the skier's leg and a quick elastic return rearwardly during the subsequent extension phase;
- the possibility of varying such action by substituting an insert element of required stiffness into the basic stiffening element; and
- the capability of the parts being produced in molds and with traditional equipment without modifications, and easy replacement of the stiffening element in case of breakage.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A ski boot having an elastically inclinable forward leg portion, a front stiffening element for said leg portion having substantially the vertical profile of the front of the ski boot, the stiffening element having an elongated body portion which is elastically pliable and the stiffening element being joined to the boot, and an elongated interchangeable insert for the stiffening element of greater stiffness than the stiffening element.

2. A ski boot as defined in claim 1, and the stiffening element being joined near its lower end to the boot by a fixed connector and having a hooking element near its upper end engageable in a slit formed in the upper edge of the boot tongue.

3. A ski boot as defined in claim 1, and the elongated elastically pliable portion of the stiffening element having a longitudinal groove for housing the interchangeable insert.

4. A ski boot as defined in claim 3, and the insert and groove having a complementary cross section to enable snapping the insert into the groove.

5. A ski boot as defined in claim 4, and the groove and insert having a dovetailed cross section.

6. A ski boot as defined in claim 1, and at least the lower end of the stiffening element being widened for stability.

* * * * *